US011405990B2

(12) United States Patent
Heo

(10) Patent No.: US 11,405,990 B2
(45) Date of Patent: Aug. 2, 2022

(54) INDUCTION HEATING COOKING DEVICE

(71) Applicant: LG ELECTRONICS INC., Seoul (KR)

(72) Inventor: Jeashik Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 435 days.

(21) Appl. No.: 16/484,012

(22) PCT Filed: Feb. 6, 2018

(86) PCT No.: PCT/KR2018/001601
§ 371 (c)(1),
(2) Date: Aug. 6, 2019

(87) PCT Pub. No.: WO2018/147621
PCT Pub. Date: Aug. 16, 2018

(65) Prior Publication Data

US 2020/0022228 A1 Jan. 16, 2020

(30) Foreign Application Priority Data

Feb. 7, 2017 (KR) ..... 10-2017-0016873

(51) Int. Cl.
*H05B 6/06* (2006.01)
*H05B 6/12* (2006.01)
(Continued)

(52) U.S. Cl.
CPC ..... *H05B 6/062* (2013.01); *F24C 7/067* (2013.01); *F24C 7/082* (2013.01); *H05B 6/1218* (2013.01); *H05B 6/1272* (2013.01)

(58) Field of Classification Search
CPC .. H05B 2213/05; H05B 6/1218; H05B 6/062; H05B 6/1272; F24C 7/067; F24C 7/082; Y02B 40/00
See application file for complete search history.

(56) References Cited

U.S. PATENT DOCUMENTS 4,334,135 A 6/1982 Smith
4,447,691 A * 5/1984 Mizukawa ..... H05B 6/062 219/626
(Continued)

FOREIGN PATENT DOCUMENTS

EP 2 405 714 A1 1/2012
EP 2 405 715 A1 1/2012
(Continued)

OTHER PUBLICATIONS

International Search Report (with English Translation) and Written Opinion dated May 1, 2018 issued in Application No. PCT/KR2018/001601.
(Continued)

*Primary Examiner* — Dana Ross
*Assistant Examiner* — Kuangyue Chen
(74) *Attorney, Agent, or Firm* — KED & Associates LLP

(57) ABSTRACT

Provided is an induction cooking apparatus including a heating part including a working coil forming a heating region and configured to heat a container placed in the heating region, an inverter configured to supply a driving voltage to the working coil, a plurality of sensing coils arranged along a circumferential portion of the working coil and sensing the container placed in the heating region, and a controller configured to determine whether to drive the inverter on the basis of information acquired from the plurality of sensing coils.

17 Claims, 10 Drawing Sheets

(51) Int. Cl.
*F24C 7/06* (2006.01)
*F24C 7/08* (2006.01)

(56) References Cited

U.S. PATENT DOCUMENTS

| | | | | |
|---|---|---|---|---|
| 9,084,295 | B2 * | 7/2015 | Sadakata ..... | H05B 6/062 |
| 2006/0054617 | A1 | 3/2006 | Ryu et al. | |

FOREIGN PATENT DOCUMENTS

| | | | |
|---|---|---|---|
| EP | 2 437 573 | A1 | 4/2012 |
| JP | 2004-022304 | | 1/2004 |
| KR | 10-2006-0023013 | | 3/2006 |
| KR | 10-1395512 | | 5/2014 |
| KR | 10-1469902 | | 11/2015 |
| KR | 10-2016-0146376 | | 12/2016 |

OTHER PUBLICATIONS

Extended European Search Report dated Nov. 25, 2020 issued in Application 18751906.1.

* cited by examiner

INDUCTION HEATING COOKING DEVICE

CROSS-REFERENCE TO RELATED PATENT APPLICATIONS

This application is a U.S. National Stage Application under 35 U.S.C. § 371 of PCT Application No. PCT/KR2018/001601, filed Feb. 6, 2018, which claims priority to Korean Patent Application No. 10-2017-0016873, filed Feb. 7, 2017, whose entire disclosures are hereby incorporated by reference.

TECHNICAL FIELD

The present invention relates to an induction cooking apparatus.

BACKGROUND ART

An induction cooking apparatus is an electric cooking device in which a high frequency current flows through a working coil or a heating coil and an eddy current flows when a strong magnetic line of force generated due to the high frequency current passes through a container (i.e., a cooking container) to heat the container itself to perform a cooking function.

As for a basic heating principle of the induction cooking apparatus, when a current is applied to the heating coil, a conductive container, which is a magnetic material, generates heat by induction heating and the conductive container itself is heated by the generated heat to perform cooking.

An inverter used in an induction cooking apparatus serves to switch a voltage applied to a heating coil so that a high-frequency current flows through the heating coil. The inverter drives a switching element typically configured as an insulated gate bipolar transistor (IGBT) so that a high frequency current flows through the heating coil to form a high frequency magnetic field in the heating coil.

The induction cooking apparatus includes a body, an upper plate for forming an appearance of an upper part of the body, a heating region in which a conductive container is seated on the upper plate and heated, and an operating unit for controlling an operation of the induction cooking apparatus by a user.

Meanwhile, a conductive container may be seated to be eccentric from the center of the heating region to deviate from the heating region. If the conductive container is seated to be eccentric (i.e., off-centered) in the heating region, heating efficiency of the induction cooking apparatus may be lowered. In addition, a cooking time is lengthened, thereby degrading user convenience.

Therefore, in the induction cooking apparatus, eccentricity of the conductive container from the center of the heating region is measured, and when the measured eccentricity of the cooking apparatus is equal to or higher than a set value, it is necessary to stop heating the conductive container.

To this end, Korean Patent Laid-Open Publication No. 10-2006-0023013 (published on Mar. 13, 2006), as a related art document, discloses an induction cooking apparatus whose operation is interrupted according to eccentricity of a conductive container.

The induction cooking apparatus of a related art document includes a power supply unit rectifying and filtering AC power to supply power to a circuit of the induction cooking apparatus, an inverter unit performing a switching operation according to an input signal Vin supplied by the power supply unit to apply a current to a coil on which a conductive container is seated, a constant output controller for outputting a pulse width control signal Vc so that a width of a driving pulse applied to the inverter unit in response to an input signal varied according to a degree of eccentricity of the conductive container is varied so that the inverter unit outputs constant power, a small container detecting unit connected to an output terminal of the constant output controller, determining that there is no conductive container if the input signal Vin is smaller than the reference signal Vref operating in synchronization with the pulse width control signal Vc, and outputting a feedback signal Vfd so that the operation of the inverter unit is interrupted, and a microcomputer applying a constant power control signal to the constant power controller so that the inverter unit may output constant power, and interrupting driving of the inverter unit if the feedback signal Vfd is 0.

Meanwhile, in the case of the induction cooking apparatus of the related art, the small container detecting unit determines that there is no conductive container when the reference signal Vref is smaller than the input signal Vin. Therefore, although the conductive container is seated in a part of the heating region and may be cooked, it is determined that there is no conductive container in the heating region and the driving of the inverter is interrupted. As a result, user inconvenience is caused.

Further, in the case of an athermic container formed of a material having a low non-metal resistance such as aluminum, the reference container signal Vref may be detected to be smaller than the input signal Vin. That is, the condition for detecting the athermic container by the small container detecting unit is similar to a condition for measuring eccentricity of the conductive container in the heating region. Therefore, it is difficult for the small container detecting unit to distinguish between a degree of eccentricity of the conductive container and whether the athermic container is present.

Also, in a case where the induction cooking apparatus is operated while moisture is present between a lower surface of the conductive container and the heating region, bubbles may be generated as the moisture evaporates. The bubbles may cause the conductive container to slip to become eccentric in the heating region. In this case, driving of the inverter may be interrupted depending on eccentricity of the conductive container. Therefore, in order to smoothly cook, when eccentricity occurs, a user needs to recognize that and place the conductive container in the heating region. Meanwhile, in the case of the related art, there is no means for letting the user recognize the eccentricity of the conductive container generated in the heating region. Therefore, user inconvenience is caused

DISCLOSURE

Technical Problem

An aspect of the present invention is directed to providing an induction cooking apparatus capable of measuring eccentricity of a container seated in a heating region more accurately and determining whether to perform heating on the basis of the measured eccentricity.

Another aspect of the present invention is directed to providing an induction cooking apparatus capable of distinguishing between whether a container is eccentric and whether the container seated in the heating region is thermally conductive (i.e., heatable).

Another aspect of the present invention is directed to providing an induction cooking apparatus capable of transmitting state information of a container seated in a heating region to a user.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Technical Solution

To achieve these and other advantages and in accordance with the purpose of the invention, as embodied and broadly described herein, there is provided an induction cooking apparatus including: a heating part including a working coil for heating a container seated in a heating region; an inverter configured to supply a driving voltage to the working coil; a plurality of sensing coils arranged along a circumferential portion of the working coil and configured to detect the container seated in the heating region; and a controller configured to determine whether to drive the inverter on the basis of information acquired from the plurality of sensing coils.

The controller may compare the sensing value acquired from the sensing coils with a set value.

The controller may determine at least one of whether a container is seated in the heating region and whether the seated container is thermally conductive.

The set value may include a first state set value for determining whether the container seated in the heating region is eccentric.

If the sensing values acquired from the plurality of sensing coils is greater than the first state set value, the controller may control the inverter to heat the container seated in the heating region.

Also, if one of the sensing values acquired from the plurality of sensing coils is greater than the first state set value and another sensing value is smaller than the first state set value, the controller may determine that the container seated in the heating region is eccentric, and interrupts driving of the inverter.

Also, the set value may further include an eccentricity set value, as a reference value set in a range between the first state set value and the second state set value, for determining whether the container seated in the heating region is thermally conductively eccentric (i.e., heatably eccentric).

Also, if any one sensing value acquired from the plurality of sensing coils is included in the range between the first state set value and the eccentricity set value and another sensing value is greater than the first state set value, the controller may determine that the container seated in the heating region is heatably eccentric.

If the container seated in the heating region is heatably eccentric, the controller may drive the inverter.

The induction cooking apparatus may further include: an operating unit receiving a command for a heating strength of the heating part.

If the container seated in the heating region is heatably eccentric, the controller may control driving of the inverter so that the heating strength of the heating part is equal to or greater than a heating strength input to the operating unit.

The set value may further include a second state set value smaller than the first state set value to determine whether the container seated in the heating region is thermally conductive.

Also, if the sensing values acquired from the plurality of sensing coils is included between the first state set value and the second state set value, the controller may determine that the container seated in the heating region is an athermic container.

If the container seated in the heating region is an athermic container, the controller may interrupt driving of the inverter.

In addition, if the sensing values acquired from the plurality of sensing coils is smaller than the second state set value, the controller determines that the heating region is in an empty state.

If the heating region is in a empty state, the controller interrupts driving of the inverter.

The plurality of sensing coils are arranged to be spaced apart from each other at a set interval along the circumference of the working coil.

The induction cooking apparatus may further include: a display unit configured to display information and a state of the container seated in the heating region.

Also, if the container seated in the heating region is eccentric or is an athermic container, the display unit may display a message using at least one of a voice, text, or an image The heating part may include a plurality of working coils.

The heating part may include a plurality of heating regions corresponding to the plurality of working coils.

A sensing coil may be disposed at a circumferential portion of each of the plurality of working coils.

Each of the sensing coils may detect that a container is seated in each of the heating regions corresponding to the plurality of working coils.

In addition, when a container is detected in any one of the sensing coils respectively provided in the plurality of working coils, the controller may turn on a working coil corresponding to the sensing coil.

In another aspect of the present invention, there is provided a control method of an induction cooking apparatus including: detecting a container seated in a heating region; driving an inverter corresponding to the heating region in which the container is seated; acquiring information of the container from sensing coils arranged along a circumference of the heating region; determining, by a controller, whether the container seated in the heating region is thermally conductive on the basis of the obtained information of the container; and determining, by the controller, whether to stop driving of the inverter on the basis of whether the container is thermally conductive.

The determining of whether the container is thermally conductive may include: determining whether the container seated in the heating region is eccentric on the basis of the information acquired through the sensing coils; and if it is determined that the container is eccentric, determining whether the container is heatably eccentric.

The determining of whether the container is thermally conductive may include: determining whether the container seated in the heating region is formed of a thermally conductive material on the basis of the information acquired through the sensing coils.

It is to be understood that both the foregoing general description and the following detailed description of the present invention are exemplary and explanatory and are intended to provide further explanation of the invention as claimed.

Advantageous Effects

In the induction cooking apparatus according to the present invention, the sensing coils capable of detecting a container are provided. The plurality of sensing coils may be disposed along the circumference of the heating part for heating the container. Accordingly, eccentricity of the container may be determined more accurately.

Also, in the present invention, whether the container seated in the heating region is eccentric and whether the container is thermally conductive may be separately detected by the sensing coils. Therefore, heatable eccentric range (i.e., thermally conductive eccentric range) of the container may be set to be wider, thereby improving user convenience.

Further, when a portion of a container seated in the heating region is eccentric, the controller may determine whether the conductive container is seated in the heatable eccentric range. If the conductive container is seated in the heatable eccentric range, the controller may improve a heating level. Therefore, even if the conductive container is eccentric, a cooking time expected by a consumer may be satisfied.

Further, the induction cooking apparatus includes a display unit for transferring state information of a container to the user when the container is eccentrically seated in the heating region, when the container becomes eccentric during cooking, or when an athermic container is seated. The display unit may advantageously guide the user to use the induction cooking apparatus properly.

DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 1 is a perspective view of an induction cooking apparatus according to a first embodiment of the present invention

MODE FOR INVENTION

Figure 1:
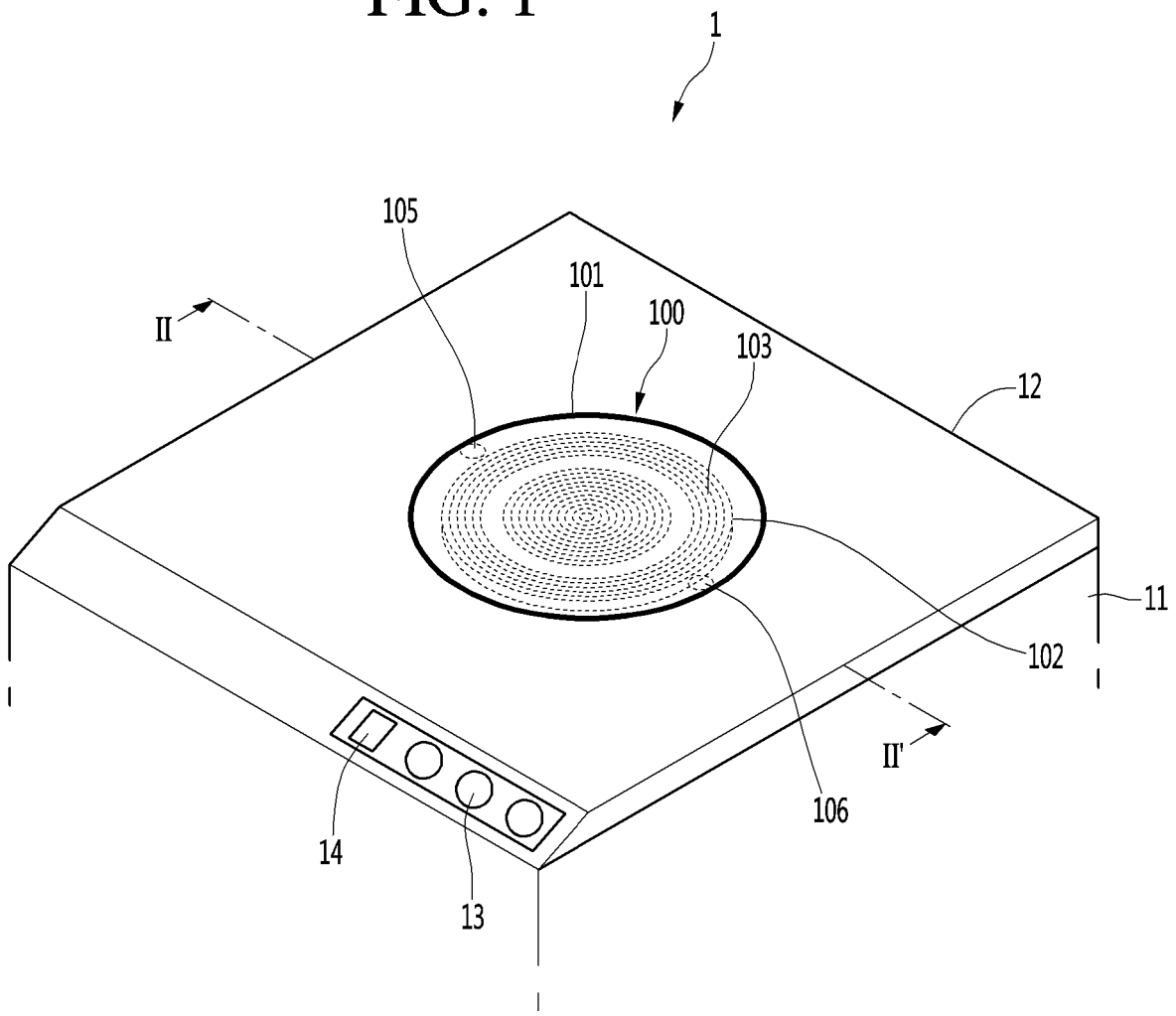
FIG. 1 is a cross section view illustrating an imprinting apparatus according to the present invention.

Reference will now be made in detail to the exemplary embodiments of the present invention, examples of which are illustrated in the accompanying drawings. Wherever possible, the same reference numbers will be used throughout the drawings to refer to the same or like parts.

Hereinafter, exemplary embodiments of the present disclosure will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present invention.

In describing the elements of the present invention, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present.

Detailed exemplary embodiments of the present invention will be described hereafter with reference to the drawings. However, the spirit of the present invention is not limited to the exemplary embodiments and other exemplary embodiments may be proposed by those understanding the spirit of the present invention without departing from the spirit.

FIG. 1 is a perspective view of an induction cooking apparatus according to a first embodiment of the present invention.

Referring to FIG. 1, an induction cooking apparatus 1 according to the first embodiment may include a main body 11 forming an internal space for accommodating a plurality of components. The main body 11 may form an appearance of a lower side of the induction cooking apparatus 1.

The main body 11 may further include a heating part 100 for generating a magnetic field to provide a heat source.

The main body 11 may further include a controller 16 for controlling the heating part 100 and a power supply unit (17 of FIG. 3) for supplying power to at least one of the heating part 100 or the controller 16. The controller 16 may be operated on the basis of a signal of an operating unit 13, which will be described later. The controller 16 may transmit power of the power supply unit 17 to the heating part 100.

When power is supplied to the heating part 100, a container seated on an upper plate 12 may be heated by a magnetic field generated by the heating part 100. Food contained in the container may be cooked. The container may include a container formed of a magnetic material, such as iron, steel or the like in at least part thereof.

In the present disclosure, a container which is formed of a magnetic material such as iron or steel and which is thermally conductive (i.e., which can be heated) is called a conductive container. Also, a container which is formed of a material having a low nonmetal resistance such as aluminum and which is unheatable is called an athermic container.

Meanwhile, the upper plate 12 may have a predetermined thickness. For example, the upper plate 12 may be formed of heat-reinforced glass of a ceramic material and may have heat resistance.

A heating region 102 for cooking may be formed on an upper surface of the upper plate 12 corresponding to the heating part 100. When the container is seated in the heating region 102, the container may be heated. The heating region 102 may have a size corresponding to a size of the heating part 100.

The upper plate 12 may be provided with a guide line 101 for guiding the container to be seated in a regular position on the heating region 102. By the guide line 101, the upper plate 12 may be divided into a region including the heating region 102 and a non-heated region in which heating of the container is not performed even if the container is seated. The act of putting the container in the regular position by the user may refer to an act of seating the container on the guide line 101 having the heating region on an inner side thereof.

Meanwhile, when the heating part 100 is provided in plurality, the guide lines may be provided in a number corresponding to the number of the heating parts. The guide line 101 may be formed to be equal to or larger than a circumferential portion of the heating region. The guide line 101 may be formed on an outer upper surface or an inner upper surface of the upper plate 12. The guide line 101 may be formed of a thermosetting material, for example.

The upper plate 12 may include an operating unit 13 for controlling an operation of the controller 16. The operating unit 13 may be applied in various ways such as a button, a knob, and a touch screen. Therefore, the user may set the induction cooking apparatus 1 according to a desired purpose by using the operating unit 13. For example, the user may determine a heating level (or a heating intensity) of the heating part 100 by using the operating unit 13. The heating part 100 may be operated at the set heating level. The heating level of the heating part 100 may be determined by intensity of a magnetic field applied to the heating part 100.

The upper plate 12 may further include a display unit 14 as a means for displaying information and a state of the heating part 100 and the container seated on the heating part 100 and the heating part. The display unit 14 may display information input to the operating unit 13. For example, the display unit 14 may display a heating level of the heating part 100 set through the operating unit 13.

When the cooking of the induction cooking apparatus 1 is stopped or abnormality occurs in the state of the induction cooking apparatus 1, the display unit 14 may display a message for the user to recognize.

Figure 2:
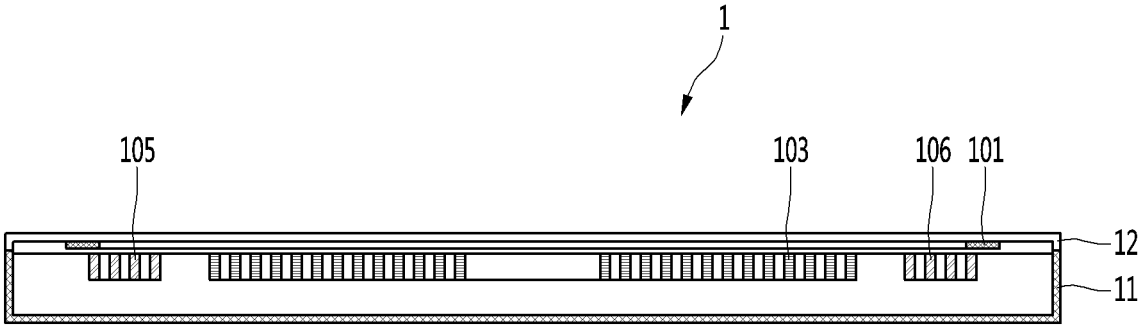
FIG. 2 is a cross-sectional view taken along line II-II' of FIG. 1.
Figure 3:
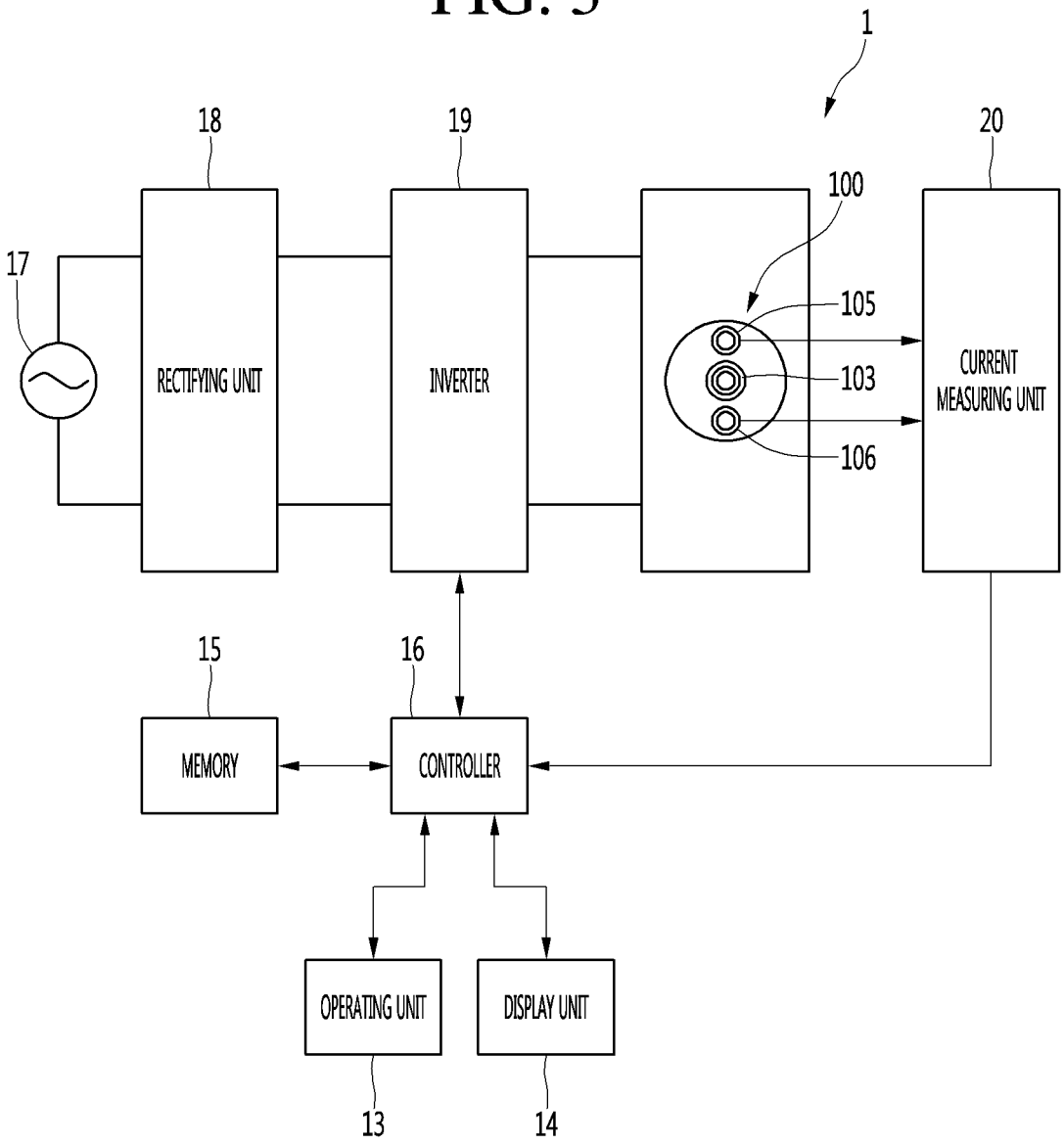
FIG. 3 is a block diagram of an induction cooking apparatus according to the first embodiment.

FIG. 2 is a cross-sectional view taken along line II-II' of FIG. 1, and FIG. 3 is a schematic view of a circuit configuration of an induction cooking apparatus according to a first embodiment.

The heating part 100 may include a working coil 103 which is an electric induction heating element. When a current is applied to the working coil 103, the conductive container, which is a magnetic body, generates heat by induction heating, and the conductive container is heated by the generated heat to perform cooking.

In order to supply current to the working coil 103, the main body 11 may further include an inverter 19 for switching a voltage applied to the working coil 103. A high frequency current may flow through the working coil 103 by the inverter 19. The main body 11 may further include a rectifying unit 18 for rectifying power supplied from the power supply unit 17 in order to supply power for driving the inverter 19. Meanwhile, the inverter 19 may be controlled by the controller 16 to switch the applied power.

To sum up, the rectifying unit 18 may rectify power supplied from the power supply unit 17 to power to be supplied to the inverter 19. The power rectified by the rectifying unit 18 may be applied to the inverter 19. The inverter 19 may switch a voltage applied to the working coil 103 so that a high frequency current flows through the working coil 103. Therefore, a high-frequency magnetic field may be formed in the working coil 103. In addition, an eddy current flows in the conductive container seated in the heating region 102 so that cooking may be performed.

The heating part 100 may further include sensing coils 105 and 106 for sensing that the container is seated in the heating region 102. The sensing coils 105 and 106 may be disposed along a circumferential portion of the heating part 100.

When a conductive container is seated in the heating region, a magnetic field may be formed due to the conductive container seated in the sensing coils 105 and 106. In detail, when the heating of the conductive container is started, a magnetic field may be formed in the sensing coils 105 and 106 due to the eddy current flowing in the conductive container. A current may flow through the sensing coils 105 and 106 due to the magnetic field formed by the eddy current.

In order to determine a position of the conductive container seated in the heating region (whether the conductive container is seated in a regular position or seated to be eccentric), the main body 11 may have a current measuring unit for measuring a current flowing through the sensing coils 105 and 106. The current values of the sensing coils 105 and 106 measured by the current measuring unit 20 may be input to an AD converter (not shown) provided separately in the main body 11. The current value input by the AD converter may be converted into a digital signal and input to the controller 16.

In this embodiment, the controller 16 may check a state of the container seated in the heating region only by the configuration of the sensing coils 105 and 106 and the current measuring unit 20. That is, since the heating region detecting unit is implemented with a relatively simple configuration, the design and configuration of the induction cooking apparatus may be simplified and design cost may be reduced. In addition, it is possible to design a more compact induction cooking apparatus by simplifying the design configuration.

In this specification, current values of the sensing coils 105 and 106 converted into a digital signal by the AD converter may be called sensing values.

Meanwhile, the current measuring unit 20 may include a shunt resistor for obtaining a current value. The shunt resistor may be connected to the sensing coils in parallel.

The controller 16 may check a position of the upper plate 12 corresponding to an upper portion of the heating part 100, that is, whether the conductive container is seated in the heating region 102, using the sensing values.

Meanwhile, the sensing coils 105 and 106 may be provided in plurality. The plurality of sensing coils 105 and 106 may be disposed along the circumferential portion of the heating part 100 (or the working coil 103). When the sensing coils 105 and 106 are disposed along the circumferential portion of the heating part 100, the controller 16 may determine whether the container seated in the heating region is eccentric on the basis of values input from the sensing coils 105 and 106. Of course, the controller 16 may check an empty state of the heating region on the basis of values input from the sensing coils 105 and 106.

In order to more accurately detect whether the conductive container is eccentric, the plurality of sensing coils 105 and 106 are arranged and spaced apart from each other at a set interval along the circumferential portion of the heating region.

When the guide line 101 is formed to be larger than the circumferential portion of the heating part 100, the plurality of sensing coils 105 and 106 may be disposed inside the guide line 101. Of course, the plurality of sensing coils 105 and 106 may also be arranged in a portion of the guide line 101.

In this disclosure, a plurality of sensing coils 105 and 106 may be provided in the heating part 100, but it is described that two sensing coils 105 and 106 are provided in the heating part 100 for the sake of explanation. That is, in the following description, the heating part 100 is provided with the first sensing coil 105 and the second sensing coil 106. The first sensing coil 105 and the second sensing coil 106 may be disposed along the circumferential portion of the heating part 100 (or the working coil 103). In other words, the first sensing coil 105 may be disposed to face the second sensing coil 106 with respect to the center of the heating part 100.

The controller 16 may compare the sensing values acquired in the first and second sensing coils 105 and 106 with a preset value stored in the memory 15 to determine at least one of whether the container is thermally conductive, whether the container is eccentric, and an empty state of the heating region 102. Specifically, the set value may include a first state set value for checking at least one of whether the container is thermally conductive and a container eccentric state in the heating region 102 and a second state set value for checking an empty state of the heating region 102. Here, the first state set value may be larger than the second state set value.

For example, when the sensing values of the first and second sensing coils 105 and 106 are larger than the first state set value, the controller 16 may determine that the container seated in the heating region 102 is thermally conductive. In addition, the controller 16 may determine that the container is accurately positioned in the heating region 102. Therefore, the container may be heated by the heating part 100.

Alternatively, when the sensing value of the first sensing coil 105 is larger than the first state set value and the sensing value of the second sensing coil 106 is smaller than the first state set value, the controller 16 may determine that the container is eccentric to the first sensing coil 105 side. When eccentricity of the container is determined, the controller 16 may display a warning of the eccentricity of the conductive container to the user through the display unit 14. By the warning displayed on the display unit 14, the user may recognize that the container is eccentric. Thus, the user may correctly place the eccentric conductive container in the heating region 102.

As another example, the sensing values of the first sensing coil 105 and the second sensing coil 106 may range between the first state set value and the second state set value. In this case, the controller 16 may determine that the container seated in the heating region 102 is an athermic container which is unheatable. For example, the athermic container may be an aluminum material. When it is determined that the container seated on the heating region 102 is an athermic container, the controller 16 may display a warning to the user through the display unit 14 about the athermic container. Here, the warning may include at least one of voice, text, and image. Due to the warning display of the display unit 14, the user may replace the athermic container with a conductive container. That is, user convenience may be enhanced by informing the user of the heatability information of the container for cooking.

As another example, the sensing values of the first sensing coil 105 and the second sensing coil 106 may be smaller than the second state set value. In this case, the controller 16 may determine that the heating region 102 is in an empty state. Therefore, if it is determined that the heating region 102 is in an empty state during heating of the heating part 100, the controller 16 may stop the driving of the inverter 19. Therefore, user convenience may be improved. Of course, even when a heating level is input to the operating section 13 in a state in which there is no container in the heating region 102, the controller 16 may determine an empty state of the heating region 102. Thus, unnecessary power consumption may be prevented.

Hereinafter, a control method of an induction cooking apparatus according to the first embodiment will be described.

Figure 4:
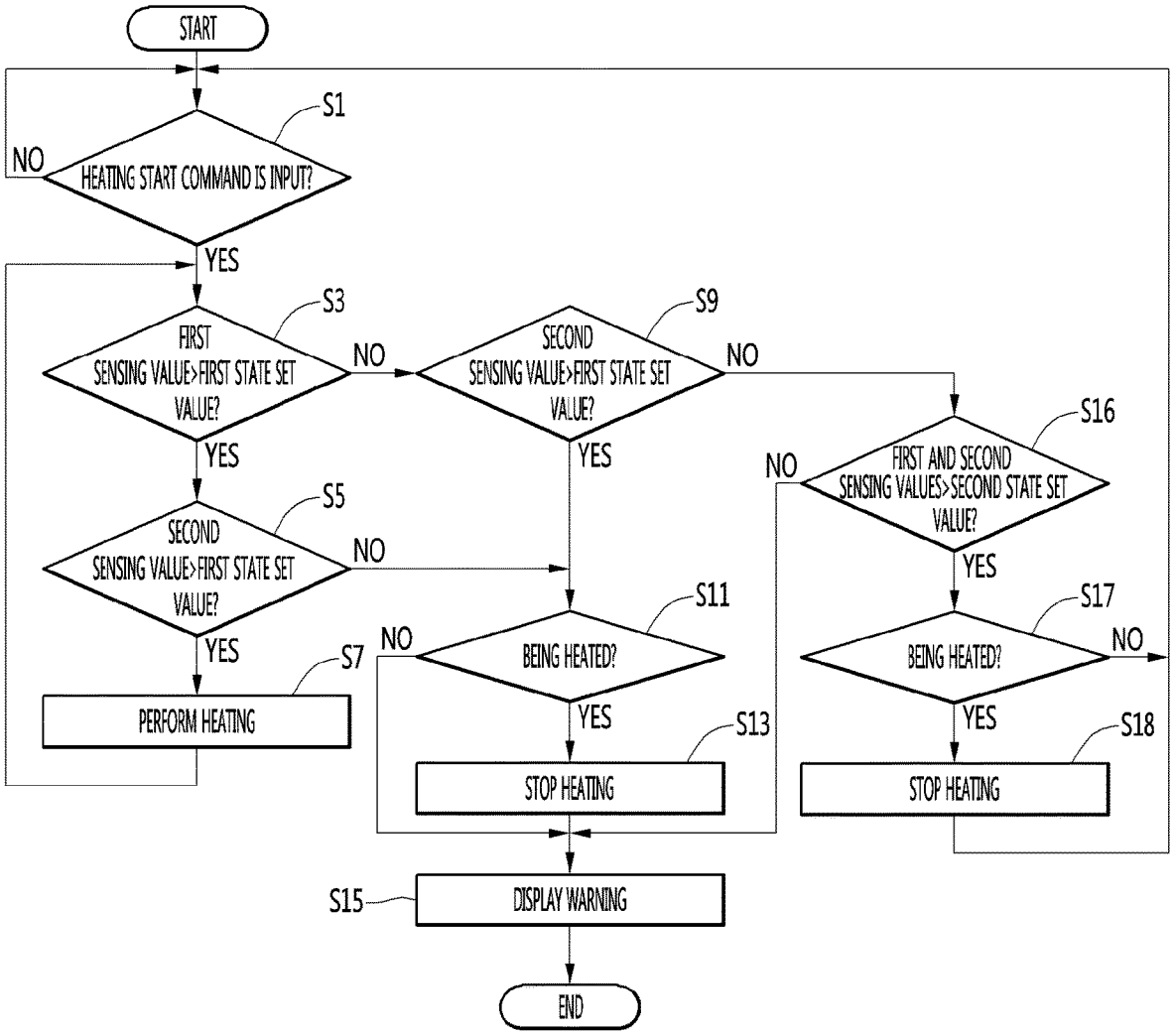
FIG. 4 is a flowchart showing a control method of an induction cooking apparatus according to the first embodiment.

FIG. 4 is a flowchart illustrating a control method of an induction cooking apparatus according to the first embodiment.

Referring to FIGS. 1 to 4, a container (container) to be heated may be seated by the user in the heating region 102. A heating start command of the heating part 100 may be input to the operating unit 13 (S1).

When the heating start command is input through the operating unit 13, the controller 16 may compare sensing values acquired in the first and second sensing coils 105 and 106 with first and second state set values stored in the memory 15 in advance. The controller 16 may determine at least one of whether a container is seated, whether the seated container is an athermic container, and whether the container is eccentric. Here, the sensing values may refer to the current values of the first and second sensing coils 105 and 106 measured by the current measuring unit 20 which are input to the controller 16 after being converted through the AD converter.

Here, the sensing value acquired by the first sensing coil 105 may be a first sensing value. Also, the sensing value acquired by the second sensing coil 106 may be referred to as a second sensing value.

First, the controller 16 may compare the first sensing value acquired from the first sensing coil 105 with the first state set value (S3). It may be understood that at least a portion of the conductive container is seated on the first sensing coil 105 side in the heating region 102 if the first sensing value is larger than the first state set value.

If the first sensing value is larger than the first state set value, the controller 16 may compare the second sensing value acquired from the second sensing coil 106 with the first state set value (S5). It may be understood that at least a portion of the conductive container is seated on the second sensing coil 106 side in the heating region 102 if the second sensing value is larger than the first status set value.

To sum up, when the first sensing value and the second sensing value are larger than the first state set value, it may be understood that the conductive container is accurately positioned in the heating region 102. Therefore, the controller 16 may control the heating part 100 to heat the conductive container seated in the heating region 102 on the basis of the heating start command input to the operating unit 13 (S7).

Meanwhile, the first sensing value may be smaller than the first state set value (S3) and the second sensing value may be larger than the first state set value (S9). In this case, it may be understood that the conductive container is eccentric to the second sensing coil side in the heating region 102.

Alternatively, the first sensing value may be larger than the first state set value (S5) and the second sensing value may be smaller than the first state set value (S9). In this case, it may be understood that the conductive container is eccentric to the first sensing coil side in the heating region 102.

When it is determined that the conductive container is eccentric, the controller 16 may check whether the conductive container seated in the heating region is heated (S11). In other words, the controller 16 may determine whether the inverter 19 that generates a high frequency current in the working coil 103 of the heating region 102 operates.

When the conductive container seated in the heating region 102 is being heated, the controller 16 may stop the operation of the inverter 19 (S13). That is, heating of the conductive container seated in the heating region 102 may be stopped.

In order to inform the user that the heating is stopped, the controller 16 may display a message through the display unit 14. The message may be displayed by at least one of voice, text, and image through the display unit 14. As it is displayed that the heating is stopped on the display unit 14, the user may recognize that the heating of the conductive container is stopped. Thus, the user may accurately position the conductive container in the heating region.

Meanwhile, if it is determined in step S11 that the container is not being heated, the controller 16 may display a message through the display unit 14. Therefore, the user may easily recognize eccentricity of the conductive container and may accurately position the conductive container in the heating region 102.

The first sensing value may be smaller than the first state set value in step S3 and the second sensing value may be smaller than the first state set value in step S9. In this case, the container seated in the heating region may be an athermic container which is impossible to heat or the heating region may be in an empty state.

Accordingly, the controller 16 may compare the first sensing value and the second sensing value with the second state set value to determine whether the container is an athermic container and whether the heating region has a container (S16).

If the first sensing value and the second sensing value are larger than the second state set value, it may be understood that the container is an athermic container which is limited in heating. In other words, when the first sensing value and the second sensing value are in a range between the first state set value and the second state set value, the container may be understood as an athermic container. The athermic container may include, for example, aluminum. Accordingly, the controller 16 may control the display unit 14 to display a message indicating that the container seated in the heating region 102 is an athermic container.

If the first sensing value and the second sensing value are smaller than the second state set value, it may be understood that the heating region may is in an empty state. The controller 16 may determine whether the heating region is being heated (S17).

When the heating region is being heated, the controller 16 may stop driving of the inverter 19 to stop heating (S18).

In contrast, when the heating region is not being heated (S17), the controller 16 may initiate the heating start command. Also, the controller 16 may be switched to the standby mode (S1). The standby mode may be understood as a preparation stage for receiving a heating start command.

According to this embodiment, the plurality of sensing coils may be disposed in the heating region. The sensing values acquired from the sensing coils may be compared with the predetermined set state value to determine whether a conductive container is seated in the heating region.

Further, eccentricity of the conductive container seated in the heating region may be more accurately determined by the plurality of sensing coils.

In addition, when the conductive container is eccentric, heating of the heating region may be stopped, thereby further improving efficiency of power consumption.

Further, whether the conductive container is eccentric and whether the container seated in the heating region is thermally conductive, that is, whether the container is an athermic container, may be determined.

When the conductive container is eccentric or when the container seated in the heating region is an athermic container, the controller may display information on the container seated in the heating region to the user through the display unit. Accordingly, the user may be guided to properly use the induction cooking apparatus The second embodiment will be described below.

Differences of the second embodiment from the first embodiment will be mainly described and a description of the same parts will be omitted.

Compared with the first embodiment, in the second embodiment, a heating level (or heating strength) of the heating part is varied when it is determined that the heating level (or the heating intensity) of the heating section is varied when it is determined that the eccentric conductive container is positioned in a heatable eccentric range.

Figure 5:
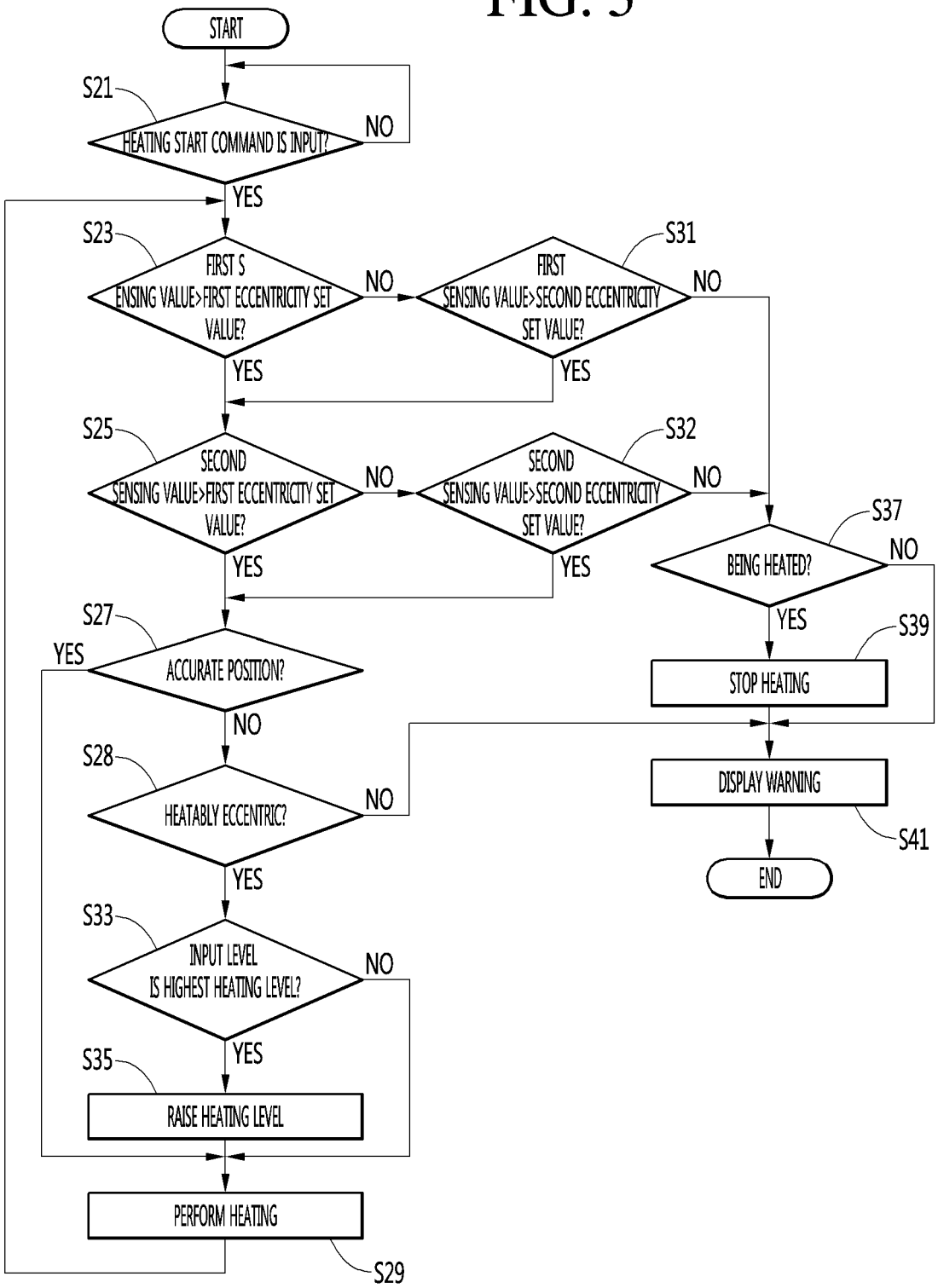
FIG. 5 is a flowchart showing a control method of an induction cooking apparatus according to a second embodiment.

FIG. 5 is a flowchart showing a control method of the induction cooking apparatus according to the second embodiment.

Referring to FIG. 5, a container to be heated by a user may be seated in the heating region 102. A heating start command of the heating region 102 may be input through the operating unit 13 (S21).

The heating start command may include a heating level for heating a container seated in the heating region 102. The heating level may be determined on the basis of an intensity of a magnetic field generated in the working coil 103 of the heating region 102. The heating level may be proportional to the intensity of the magnetic field generated in the working coil 103 of the heating part 100. Meanwhile, the intensity of the magnetic field may be determined by controlling the inverter 19 by the controller 16.

When the heating start command is input, the controller 16 may compare the sensing values acquired from the first sensing coil 105 and the second sensing coil 106 with a sensing value stored in the memory 15. The set value may include an eccentricity set value for checking whether the conductive container seated in the heating region is eccentric when compared with the sensing values. When the eccentricity set value includes a plurality of levels, the controller 16 may measure eccentricity of the conductive container seated in the heating region by comparing the sensing values with each of the eccentricity set values including a plurality of levels.

The eccentricity set value may include a first eccentricity set value for determining whether eccentricity has occurred and a second eccentricity set value for determining whether the eccentric conductive container is thermally conductive. The second eccentricity set value may be smaller than the first eccentricity set value.

First, the controller 16 may compare the first sensing value with the first eccentricity set value (S23). If the first sensing value is larger than the first eccentricity set value, it may be understood that at least a portion of the conductive container is seated on the first sensing coil 105 side in the heating region.

If the first sensing value is larger than the first eccentricity set value, the controller 16 may compare the second sensing value with the first eccentricity set value (S25). If the second sensing value is larger than the first eccentricity set value, it may be understood that at least a portion of the conductive container is seated on the second sensing coil 106 side in the heating region.

In the previous steps S23 and step S25, the controller 16 may determine whether the conductive container is accurately positioned and whether the conductive container is eccentric on the basis of the measurement results of comparing the first and second sensing values and the first eccentricity set value (S27, S28).

If the first sensing value and the second sensing value are larger than the first eccentricity set value (S27), it may be understood that the conductive container in the heating region 102 is at a regular position. Therefore, the controller 16 may perform heating on the conductive container on the basis of the input heating start command (S29). Here, the controller 16 may heat the conductive container to a heating level input through the operating unit 13. In other words, the controller 16 may control the inverter 19 so that a magnetic field having an intensity corresponding to the heating level input to the operating unit 13 is generated in the working coil 103.

Meanwhile, the first sensing value may be smaller than the first setting eccentricity value (S23) and the first sensing value may be larger than the second setting eccentricity value (S31). Also, the second sensing value may be larger than the first setting eccentricity value (S25). Here, in the heating region 102, the conductive container may be partially eccentric to the second sensing coil 106.

Alternatively, the first sensing value may be larger than the first setting eccentricity value (S23) and the second sensing value may be a value between the first setting eccentricity value and the second setting eccentricity value (S25, S32). Here, in the heating region 102, the conductive container may be partially eccentric to the first sensing coil 105.

In this case, it may be understood that the conductive container is partially eccentric to the second sensing coil 106 but cooking efficiency expected by the user may be satisfied when heating is performed on the conductive container. That is, it may be understood that the conductive container is heatably eccentric in the heating region 102.

In a case where the conductive container is heatably eccentric (S28), the controller 16 may determine whether the heating level input by the operating unit 13 is a highest heating level of the heating part 100 operable by the inverter 19 (S33).

If the heating level input by the operating unit 13 is the highest heating level, the controller 16 may control the heating part 100 to heat the conductive container to the heating level input to the operating unit 13 (S29).

In contrast, if the heating level input by the operating unit 13 is not the highest heating level, the controller 16 may raise the heating level of the heating part 100 by a predetermined level (S35). The controller 16 may heat the conductive container at the heating level raised by the predetermined level (S29).

Even if the conductive container is partially eccentric, a cooking time expected by the user may be satisfied. That is, user convenience may be improved.

Meanwhile, the first sensing value may be a value between the first eccentricity set value and the second eccentricity set value (S23, S31) and the second sensing value may be a value between the first eccentricity set value and the second eccentricity set value (S25, S32). In this case, the container seated in the heating region 102 may be understood as an athermic container. Therefore, the controller 16 may interrupt driving of the inverter 19. The controller 16 may display a message through the display unit 14 to notify the user that the athermic container is seated in the heating region 102. The message may be displayed as at least one of voice, text, and an image through the display unit 102.

Meanwhile, the first sensing value may be smaller than the second eccentricity set value (S31). Alternatively, the second sensing value may be smaller than the second eccentricity set value (S32). Here, the conductive container seated in the heating region may be eccentric to the second sensing coil 106 side or the first sensing coil 105 side. In this case, it may be understood that, even if heating is performed on the eccentric conductive container, cooking efficiency expected by the user is not satisfied.

Here, the controller 16 may determine whether the eccentric conductive container is being heated (S37).

If it is determined that the conductive container is being heated, the controller 16 may control the inverter 19 to stop the heating of the conductive container (39).

In order to inform the user that heating is stopped, the controller 16 may display a message through the display unit 14 (S41). The message may be displayed as at least one of voice, text, and image through the display unit 14. As the message indicating that heating is stopped is displayed on the display unit 14, the user may recognize that heating of the conductive container is stopped. Thus, the user may accurately position the conductive container in the heating region.

Meanwhile, if it is determined that the container is not being heated, the controller 16 may display the message through the display unit 14 in step S37. Therefore, the user may easily recognize the eccentricity of the conductive container and may accurately position the conductive container in the heating region.

According to this embodiment, in a case where the conductive container is eccentric in the heating region, the controller may check whether the conductive container may be seated in the heatable eccentric range. If the conductive container is seated in the heatable eccentric range, the controller may raise the heating level. Therefore, even if the conductive container is eccentric, a cooking time expected by the consumer may be satisfied.

Meanwhile, when the first and second sensing values acquired by the first and second sensing coils 105 and 106 do not satisfy the second eccentricity set values, the container seated in the heating region may be an athermic container or the heating region may be in an empty state. Accordingly, the controller 16 may compare the first and second sensing values with the second state set values of the previous embodiment (first embodiment) to determine whether the conductive container is an athermic container or whether the heating region is in an empty state. Here, the first eccentricity set value may be the same set value as the first state set value of the first embodiment. Also, the second eccentricity set value may be a value set in a range between the first state set value and the second state set value Hereinafter, a third embodiment will be described.

Differences of the third embodiment from the previous embodiments will be mainly described and a description of the same parts will be omitted.

Compared with the previous embodiments, in the third embodiment, a plurality of heating parts are provided and a conductive container is detected by a sensing coil provided in each heating part.

Figure 6:
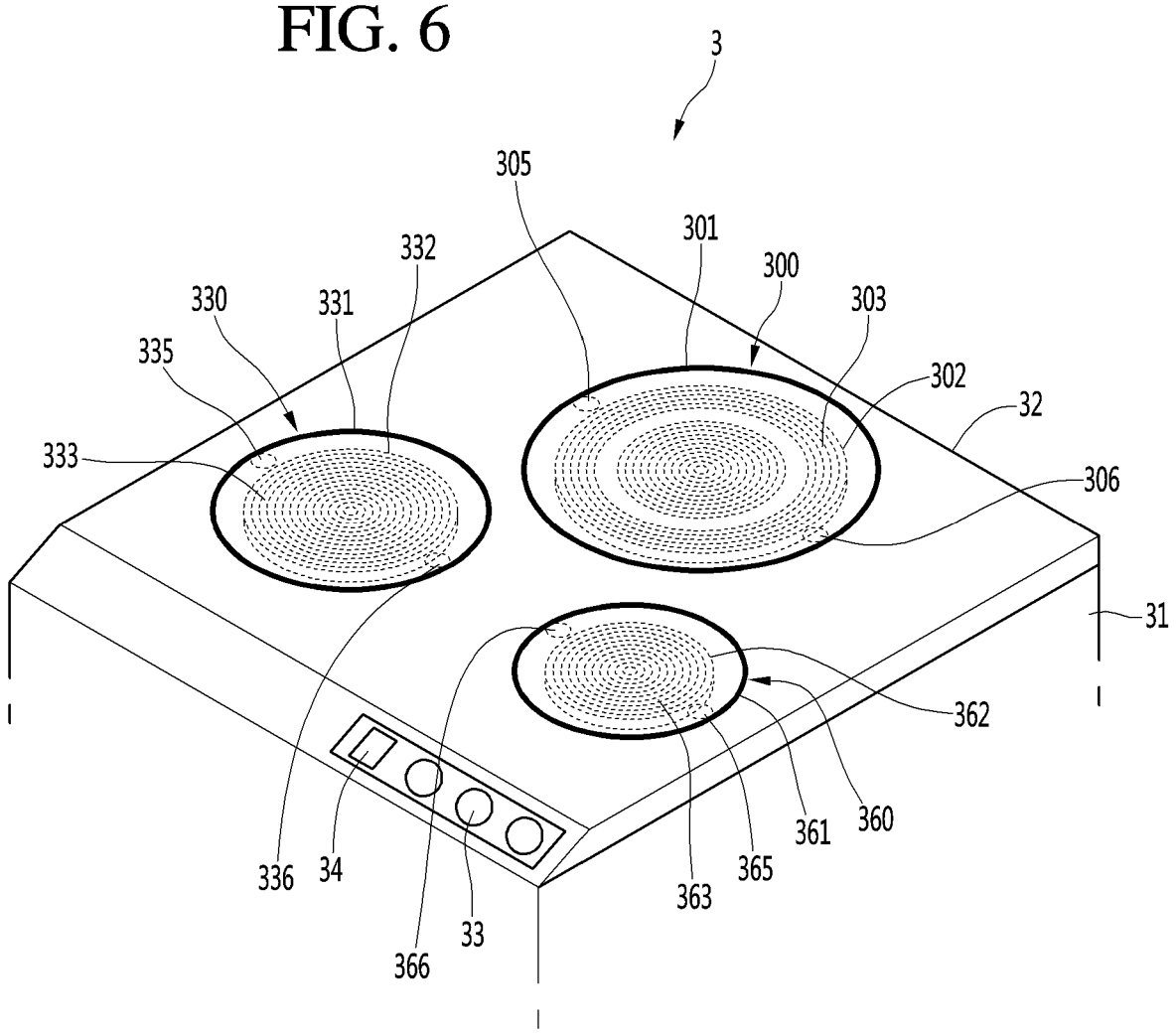
FIG. 6 is a perspective view of an induction cooking apparatus according to a third embodiment.

FIG. 6 is a perspective view of an induction cooking apparatus according to the third embodiment.

Figure 7:
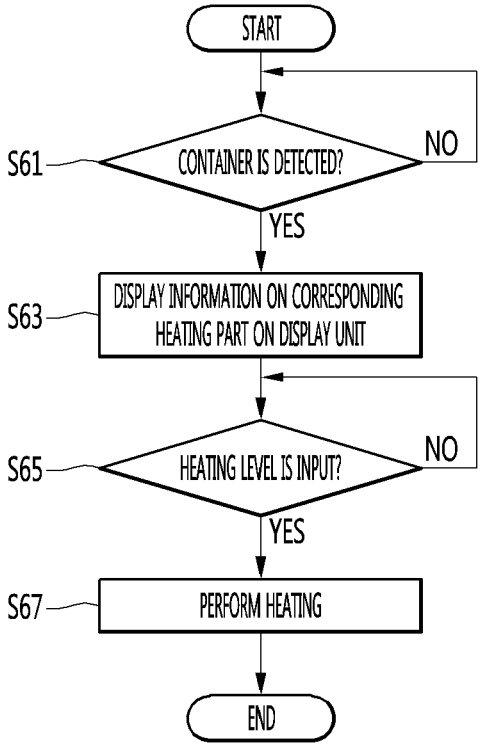
FIG. 7 is a flowchart showing a control method of an induction cooking apparatus according to the third embodiment.

Referring to FIGS. 6 and 7, the induction cooking apparatus 3 according to the third embodiment may include a main body 31 and upper plate 12 or 32 which are seated on an upper portion of the main body 31. The main body 31 may include a plurality of heating parts 300, 330, and 360. The plurality of heating parts 300, 330, and 360 may include a first heating part 300, a second heating part 330, and a third heating part 360.

The first to third heating parts 300, 330, and 360 may include a sensing coil sensing that a container is seated in a heating region corresponding to each heating part and working coils 303, 333, and 363 for heating a seated container. In detail, the first heating part 300 may include the first heating part working coil 303 and the first heating part sensing coils 305 and 306. The second heating part 330 may include the second heating part working coil 333 and the second heating part sensing coils 335 and 336. The third heating part 360 may include the third heating part working coil 363 and the third heating part sensing coils 365 and 366.

The upper plate 12 or 32 include first to third heating regions 302, 332 and 362 formed at positions corresponding to the first to third heating parts 300, 330 and 360.

When a container is detected in at least one of the plurality of heating parts 300, 330 and 360, the sensing coil of the heating part in which the container is detected may transmit sensing information of the container to the controller. The sensing information may include at least one of heating part information on which the container is seated, whether the container seated in the heating region is thermally conductive (or athermic container), and whether the seated container is eccentric. The controller may control each of the heating parts through the sensing information.

Also, the controller may control the heating parts 300, 330, and 360 by referring to the information input to the operating unit 33. A result of the input information may be output to the display unit 34.

FIG. 7 is a flowchart showing a control method of the induction cooking apparatus according to the third embodiment.

Referring to FIGS. 6 and 7, a container may be seated in at least one of the plurality of heating regions 302, 332, and 362 by the user. Each sensing coil corresponding to each of the heating regions 302, 332, and 362 may detect the seated container (S61).

In this embodiment, for convenience of explanation, it is assumed that the container is seated in the first heating region 302 among the plurality of heating regions 302, 332, and 362.

The controller may control the first heating part sensing coils 305 and 306 to receive information on the container seated on the first heating part 302. Further, the controller may receive information on whether the seated container is thermally conductive from the first heating part sensing coils 305 and 306. In addition, the controller may receive information on whether the seated container is eccentric from the first heating part sensing coils 305 and 306.

The controller may display the information received from the first heating part sensing coils 305 and 306 on the display unit 34. Accordingly, the user may check the information displayed on the display unit 34 and be guided to use the induction cooking apparatus 3 properly. For example, when the container is seated to be eccentric in the heating region 302 of the first heating part, eccentricity information may be displayed on the display part 34. Accordingly, the user may recognize the information displayed on the display unit 34 and may accurately position the container.

When a heating level is input through the operating unit 13, the controller may operate the first heating part 300 on the basis of the input heating level. Therefore, the conductive container seated in the first heating part heating region 302 may be heated (S67).

According to the present embodiment, the induction cooking apparatus includes a plurality of heating parts. Information of the container may be acquired by the sensing coil provided in each heating part. The controller may control each of the heating parts on the basis of the information of the container.

In particular, when abnormality occurs in any one of the containers seated in the plurality of heating regions, a heating region in which an abnormal container is seated may be detected through a sensing coil provided in each heating region. Also, a heating region in which the abnormal container is seated may be displayed through the display unit. Therefore, the user may simply recognize a state of the container. Here, the display unit may display the information using at least one of voice, text, and image.

Hereinafter, a fourth embodiment will be described.

In this embodiment, in comparison with the previous embodiments, redundant contents will be omitted. In particular, since it is described that the controller determines a type of a container using the sensing coil in the previous embodiment, and therefore, related contents thereof will be omitted.

As compared with the previous embodiment, in this embodiment, one heating part includes a plurality of working coils and one or more sensing coils arranged at a circumferential portion of each working coil. When a container is detected by the one or more sensing coils, a working coil corresponding to the sensing coil which detects the container is operated.

Figure 8:
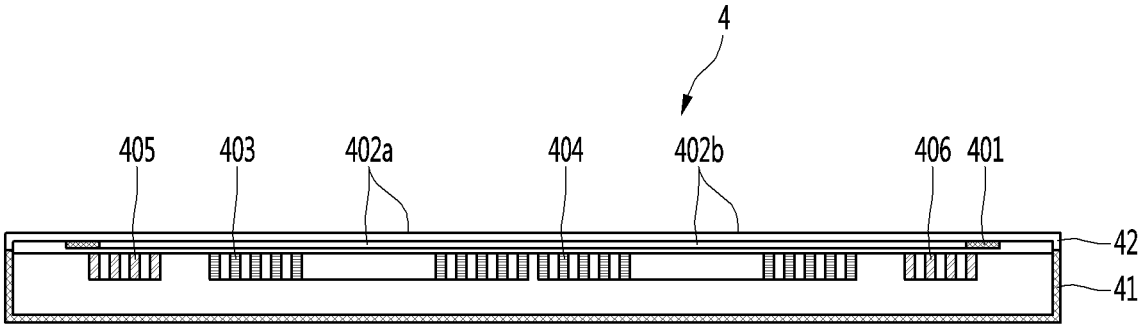
FIG. 8 is a cross-sectional view of an induction cooking apparatus according to a fourth embodiment.
Figure 9:
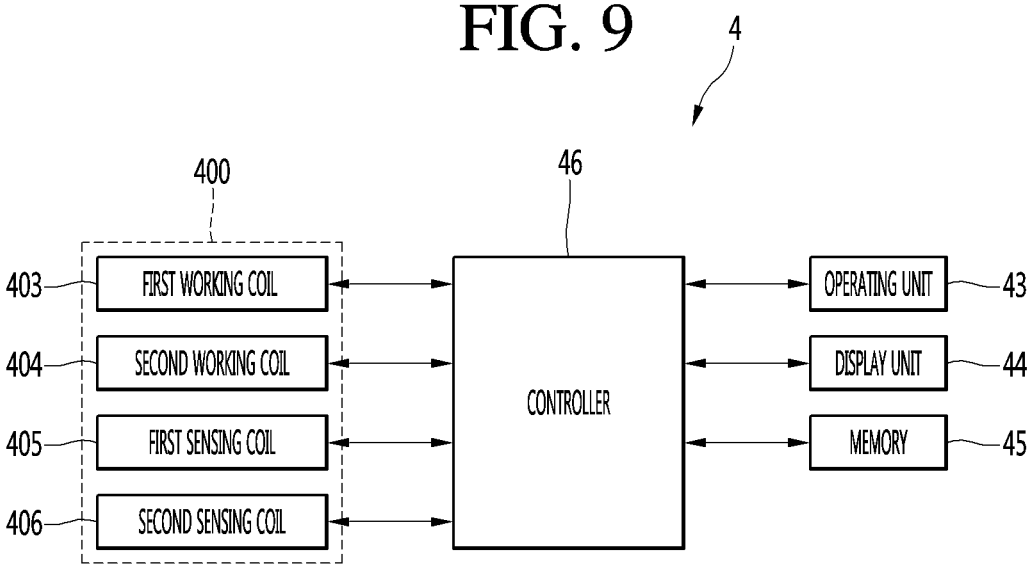
FIG. 9 is a block diagram showing a control configuration of an induction cooking apparatus according to the fourth embodiment.

FIG. 8 is a cross-sectional view of an induction cooking apparatus according to the fourth embodiment, and FIG. 9 is a block diagram showing a control configuration of an induction cooking apparatus according to the fourth embodiment.

Referring to FIGS. 8 and 9, the induction cooking apparatus 4 according to the fourth embodiment includes a main body 41 and upper plate 12 or 42 seated on an upper portion of the main body 41. The main body 41 may include a heating part 400. One or more heating parts 400 may be provided in the main body 41.

The upper plate 12 or 42 may be formed with heating regions 402*a* and 402*b* in which a container to be heated is seated at a position corresponding to the heating part 400.

The heating part 400 may include a working coil for heating the container seated in the heating region 402. A plurality of working coils may be provided in the heating part 400. In this specification, for the sake of convenience of explanation, it is assumed that the heating coil 400 includes two working coils. That is, the heating part 400 may include a first working coil 403 and a second working coil 404.

The first working coil 403 and the second working coil 404 may be spaced apart from each other at a predetermined interval so as not to interfere with each other.

Meanwhile, the heating region 402 may be formed in a number corresponding to the number of the working coils 403 and 404. That is, the heating regions 402*a* and 402*b* may include a first heating region 402*a* corresponding to the first working coil 403 and a second heating region 402*b* corresponding to the second working coil 404.

The heating part 400 may include sensing coils 405 and 406 for detecting a container seated in the heating regions 402*a* and 402*b*, respectively. The sensing coils 405 and 406 may include a first sensing coil 405 corresponding to the first heating region 402*a* to detect a conductive container seated in each of the heating regions 402*a* and 402*b*. Also, the sensing coils 405 and 406 may include a second sensing coil corresponding to the second heating region 402*b*.

A plurality of sensing coils may be provided in each heating region. However, in the present embodiment, for convenience of explanation, it is assumed that one sensing coil is provided for each sensing coil.

In addition, it is described that, in the sensing coil, a conductive container is detected by the sensing coil and an athermic container is not detected by the sensing coil.

Each of the sensing coils 405 and 406 may be disposed along a circumferential portion of the corresponding working coil 403 and 404.

If a container is detected in at least one of the first sensing coil 405 and the second sensing coil 406, the controller 46 may operate a heating part corresponding to the sensing coil in which the container is detected.

Here, the controller 46 may operate the heating part corresponding to the sensing coil in which the container is detected, by referring to information input to the operating unit 43.

In addition, the controller 46 may display the information of the detected container on a display unit 44.

Figure 10:
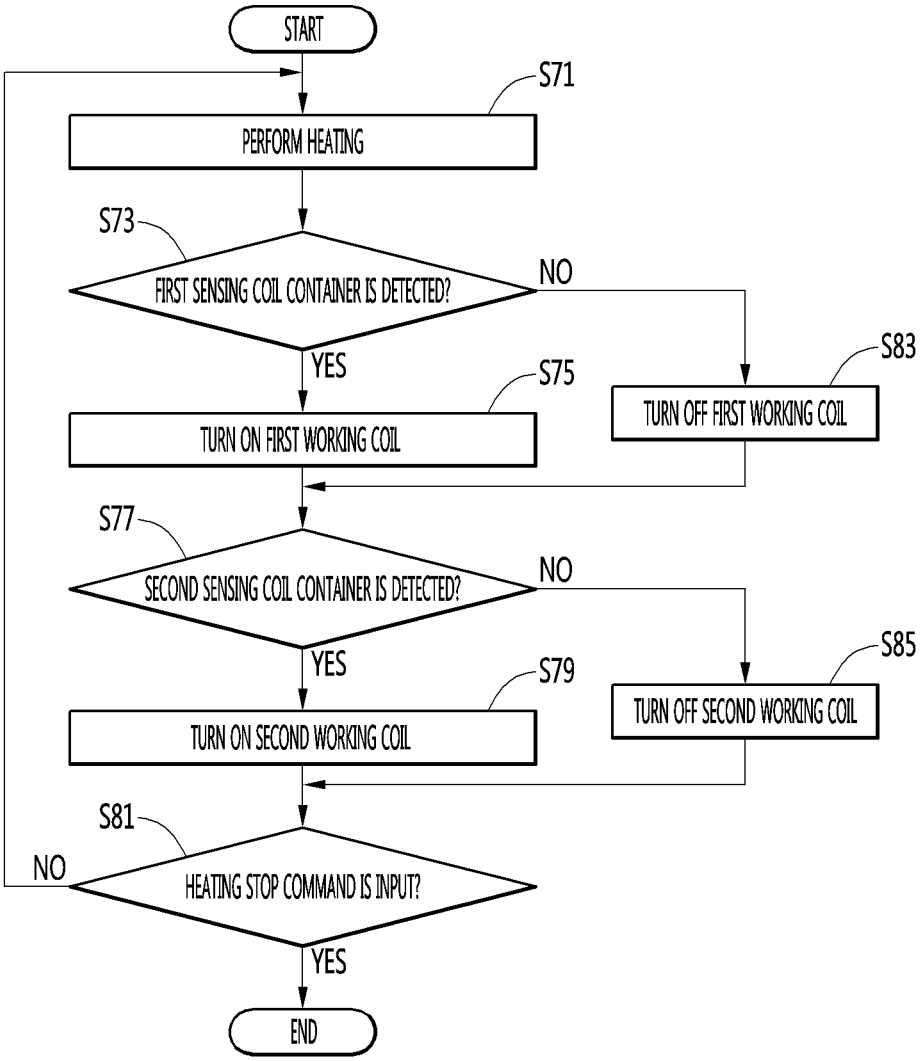
FIG. 10 is a flowchart showing a control method of an induction cooking apparatus according to the fourth embodiment.

FIG. 10 is a flowchart showing a control method of an induction cooking apparatus according to the fourth embodiment.

Referring to FIGS. 8 to 10, a container to be cooked may be seated in the plurality of heating regions 402*a* and 402*b*. A heating start command may be input to the operating unit 43 by the user. The controller 46 may perform a heating operation of the heating part 400 on the basis of the command input to the operating unit 43 (S71).

Meanwhile, the container may be detected in at least one of the first sensing coil 405 and the second sensing coil 406 according to a size of the container or a state in which the container is seated in the heating region. The controller 46 may control the operation of each of the working coils 403 and 404 on the basis of the information detected in the first sensing coil 405 and the second sensing coil 406.

More specifically, the controller 46 may check whether the first sensing coil 405 detects a container (S73).

When a conductive container is detected by the first sensing coil 405, the controller 46 may turn on the first working coil 403. Accordingly, the conductive container positioned in the heating region 402*a* corresponding to the first working coil 403 may be heated.

The controller 46 may check whether the second sensing coil 406 detects a container (S75).

When a conductive container is detected by the second sensing coil 406, the controller 46 may turn on the second working coil 404. Accordingly, the conductive container located in the heating region 402*b* corresponding to the second working coil 404 may be heated (S77).

When a conductive container is not detected by the first sensing coil 405 and the second sensing coil 406, the working coils 403 and 404 corresponding to the sensing coils 405 and 406, respectively, may be turned off (S83, S85). Therefore, efficiency of power consumption may be further improved.

The working coils 403 and 404 which are turned on by the first and second sensing coils 405 and 406 may be operated until a separate heating stop command is input (S81). Alternatively, when the user sets a heating time through the operating unit, the working coil may be turned on during the set heating time. In order to set the heating time, the main body may further include a timer (not shown) which counts and sets a time and transmits the set time to the controller.

According to the present embodiment, the plurality of working coils are provided in one heating part. In addition, the sensing coil for sensing that a container is seated in each heating region corresponding to the working coil is provided. When a container is detected in at least one of the plurality of sensing coils, the controller operates a working coil corresponding to the sensing coil in which the container is detected. Therefore, the container may be heated more efficiently, while reducing power consumption.

Further, even when a container is small, when the container is detected in the sensing coil, the working coil corresponding to the sensing coil may be operated. Therefore, user convenience may further be improved.

In the description above, although the components of the aspects of the present disclosure have been explained as assembled or operatively connected as a unit, the present disclosure is not intended to limit itself to such aspects. Rather, within the objective scope of the claimed invention, the respective components may be selectively and operatively combined in any numbers.

Terms such as "include", "form" or "have" as described above means that a concerned element may be inherent in the concerned element unless there is any statement specifically to the contrary. In this regard, such terms should be interpreted that the elements may further include other elements instead of excluding other elements. All terms including technical or scientific terms have the same meaning as generally understood by the person having the typical knowledge in the technical field to which the present invention belongs unless otherwise defined. Terms which are generally used as terms defined in dictionary should be interpreted as being consistent with the meaning in context of the relevant technology and will not be interpreted as idealistic or excessively formal meaning.

Although a few exemplary embodiments have been shown and described, it will be appreciated by those skilled in the art that changes may be made in these exemplary embodiments without departing from the principles and spirit of the invention, the range of which is defined in the appended claims and their equivalents. Accordingly, the exemplary embodiments of the present invention are provided to explain the technical spirit of the present invention but not to limit such spirit. The scope of the technical spirit of the present invention is not limited by the exemplary embodiments of the present invention. The scope of protection of the present invention should be interpreted by the claims below, and all technical spirits which are in the same scope would be interpreted as being included in the scope of right of the present invention.

The invention claimed is:

1. An induction cooking apparatus comprising:

a body having an upper surface;

a heating device on the upper surface of the body, the heating device including a working coil for heating a container to be provided at a heating region on the upper surface of the body;

an inverter configured to supply a driving voltage to the working coil;

a plurality of sensing coils arranged along a circumferential portion of the heating device, the plurality of sensing coils including a first sensing coil and a second sensing coil to detect the container at the heating region; and a controller configured to determine whether to drive the inverter based on information obtained from the plurality of sensing coils, wherein the controller is to compare a first sensing value of the first sensing coil and a second sensing value of the second sensing coil with a first state set value for determining whether the container at the heating region is eccentric, wherein when the first sensing value is greater than the first state set value and the second sensing value is smaller than the first state set value, the controller is to determine that the container at the heating region is eccentric, and the controller is to control the inverter to stop supply of the driving voltage.

2. The induction cooking apparatus of claim 1, wherein the controller is to compare the first sensing value and the second sensing value with at least one set value, and the controller is to determine at least one of whether the container is provided at the heating region and whether the container is thermally conductive based on the comparing of the first and second sensing values with the at least one set value.

3. The induction cooking apparatus of claim 2, wherein when the first and second sensing values are greater than the first state set value, the controller is to control the inverter to heat the container at the heating region.

4. The induction cooking apparatus of claim 2, wherein the at least one set value includes an eccentricity set value for determining whether the container at the heating region is heatably eccentric, wherein the eccentricity set value is a reference value that is set to a value between the first state set value and a second state set value.

5. The induction cooking apparatus of claim 4, wherein when the first sensing value is between the first state set value and the eccentricity set value and the second sensing value is greater than the first state set value, the controller is to determine that the container at the heating region is heatably eccentric, and the controller is to control the inverter to supply the driving voltage.

6. The induction cooking apparatus of claim 5, further comprising:

an operating unit to receive an input, the input corresponding to a command for a heating strength of the heating device.

7. The induction cooking apparatus of claim 6, wherein when the container at the heating region is determined to be heatably eccentric, the controller is to control driving of the inverter so that a heating strength of the heating device is equal to or greater than the heating strength that is input at the operating unit.

8. The induction cooking apparatus of claim 2, wherein the at least one set value includes a second state set value to determine whether the container at the heating region is thermally conductive, and the second state set value is smaller than the first state set value.

9. The induction cooking apparatus of claim 8, wherein when the first and second sensing values are between the first state set value and the second state set value, the controller is to determine that the container at the heating region is an athermic container, and the controller is to control the inverter to stop supply of the driving voltage.

10. The induction cooking apparatus of claim 8, wherein when the first and second sensing values are smaller than the second state set value, the controller is to determine that the heating region is an empty state, and the controller is to control the inverter to stop supply of the driving voltage.

11. The induction cooking apparatus of claim 1, wherein the plurality of sensing coils are arranged along the circumference portion of the heating device such that adjacent sensing coils are spaced apart by a set interval.

12. The induction cooking apparatus of claim 1, further comprising:

a display configured to display information relating to the container at the heating region.

13. The induction cooking apparatus of claim 12, wherein when the container at the heating region is determined to be eccentric or is determined to be an athermic container, the display is to display a message relating to the container.

14. An induction cooking apparatus comprising:

a body having an upper surface;

a heating device that includes a plurality of working coils that configure at least one heating region on the upper surface of the body;

an inverter configured to supply a driving voltage to each separate one of the plurality of working coils;

a plurality of sensing coils arranged along circumferential portions of the plurality of working coils, respectively, and the plurality of sensing coils configured to detect a container to be provided at the at least one heating region, the plurality of sensing coils includes a first sensing coil and a second sensing coil; and a controller configured to determine whether to drive the inverter based on information obtained from the sensing coils, wherein the controller is to compare a first sensing value of the first sensing coil and a second sensing value of the second sensing coil with a first state set value for determining whether the container at the heating region is eccentric, wherein when the first sensing value is greater than the first state set value and the second sensing value is smaller than the first state set value, the controller is to determine that the container at the heating region is eccentric, and the controller is to control the inverter to stop supply of the driving voltage.

15. A control method of an induction heating apparatus, the method comprising:

detecting a container provided at a heating region of a surface;

driving an inverter to provide voltage to the heating region in which the container is to be provided;

obtaining information relating to the container based on sensing coils provided along a circumference portion of the heating region;

determining, by a controller, whether the container at the heating region is thermally conductive based on the obtained information relating to the container; and determining, by the controller, whether to stop driving of the inverter based on whether the container is determined to be thermally conductive, wherein the determining of whether the container is thermally conductive comprises:

determining whether the container at the heating region is eccentric based on the information obtained from the sensing coils; and wherein the controller is to compare a first sensing value of a first sensing coil and a second sensing value of a second sensing coil with a first state set value for determining whether the container at the heating region is eccentric, wherein when the first sensing value is greater than the first state set value and the second sensing value is smaller than the first state set value, the controller is to determine that the container at the heating region is eccentric, and the controller is to control the inverter to stop driving.

16. The control method of claim 15, wherein the determining of whether the container is thermally conductive comprises:

when the container is determined to be eccentric, determining whether the container is heatably eccentric.

17. The control method of claim 15, wherein the determining of whether the container is thermally conductive comprises:

determining whether the container at the heating region is formed of a heatable material based on the information obtained from the sensing coils.

* * * * *